US006948207B2

(12) United States Patent
Daly

(10) Patent No.: US 6,948,207 B2
(45) Date of Patent: Sep. 27, 2005

(54) MATTRESS COVER WITH A ZIPPER COVERED BY A FLAP

(75) Inventor: Patrick Noel Daly, Country Cork (IE)

(73) Assignee: RBF Industries Limited, Essex (GB)

( * ) Notice: Subject to any disclaimer, the term of this patent is extended or adjusted under 35 U.S.C. 154(b) by 0 days.

(21) Appl. No.: 10/474,096

(22) PCT Filed: Apr. 8, 2002

(86) PCT No.: PCT/EP02/03883

§ 371 (c)(1),
(2), (4) Date: Feb. 17, 2004

(87) PCT Pub. No.: WO02/080736

PCT Pub. Date: Oct. 17, 2002

(65) Prior Publication Data

US 2004/0143903 A1 Jul. 29, 2004

(30) Foreign Application Priority Data

Apr. 7, 2001 (GB) ..... 0108818

(51) Int. Cl.[7] ..... A47C 27/00; A61G 9/00
(52) U.S. Cl. ..... 5/738; 5/699
(58) Field of Search ..... 5/738, 699, 482, 5/501, 737, 484

(56) References Cited

U.S. PATENT DOCUMENTS 3,241,161 A * 3/1966 Dashosh ..... 5/501
5,321,861 A 6/1994 Dancey et al. ..... 5/482
5,910,081 A 6/1999 Graham ..... 5/699
6,363,553 B1 4/2002 Baumgärtel et al. ..... 5/482

FOREIGN PATENT DOCUMENTS

DE 19755498 12/1997

* cited by examiner

*Primary Examiner*—Alexander Grosz
(74) *Attorney, Agent, or Firm*—Andrus, Sceales, Starke & Sawall, LLP

(57) ABSTRACT

A mattress cover, especially for hospital mattresses prevents the ingress of liquids to the mattress core. The mattress cover includes an opening to allow the cover to be put on, and taken off, a mattress core. The opening is closed by a zip fastener (10). The teeth (12) of the zip fastener (10) are mounted on a substrate which is impermeable to fluids. Preferably the substrate is coated with a polyurethane material (14). The teeth (12) of the zip fastener are directed inwardly towards the mattress core and the substrates act to cover the zip fastener when closed, thereby substantially preventing the ingress of fluids through the zip fastener. The opening is also provided with a cover flap which is constructed so that there are no exposed puncturing joins (such as are generated by stitching) which would allow the ingress of liquid.

7 Claims, 1 Drawing Sheet

MATTRESS COVER WITH A ZIPPER COVERED BY A FLAP

CROSS-REFERENCE TO RELATED APPLICATIONS

This application is the U.S. national stage application of International Application PCT/EP02/03883, filed Apr. 8, 2002, which international application was published on Oct. 17, 2002, as International Publication WO 02/080736 in the English language. The International Application claims priority of British Patent Application 01 08818.6, filed Apr. 7, 2001 .

This invention relates to fasteners and in particular relates to a fasteners, especially zip (or zipper) fasteners for use with covers placed over structures on which patients sit or lie in hospitals, nursing homes and the like. Such covers may be for mattresses on hospital beds or trolleys or special supporting cushions used on chairs or wheelchairs. The fasteners may also be used with mattresses in a domestic environment where, for example, and elderly person or a child is being cared for. In this specification, unless the context requires otherwise, references to mattresses and mattress covers shall be taken to include references to all mattress types mentioned above and covers for such mattresses and also to cushions and covers for cushions as mentioned above.

Taking as an example a hospital mattress, the mattress is provided with a removable cover which is generally impermeable to liquids. The mattress includes an opening which allows it to be put on and removed from the mattress core. A conventional zip fastener for closing the opening in the mattress cover is sewn onto the mattress cover, causing perforations in the cover which may allow water, urine and other fluids to gain access to the mattress core. If the mattress core becomes wet by ingress of fluid this is likely to lead to growth of bacteria which, in the worst case, can escalate to levels that are potentially harmful to patients. Moreover, cross-infection can occur when the mattress harbours bacteria which can be transferred to subsequent patients using the same mattress. In addition, fluid can pass through the teeth of the zip fastener itself.

In an attempt to improve matters, many hospital mattresses now utilise a zip with a covering flap designed to allow fluids to cascade over the zip area when falling from the top of the mattress. Sometimes these mattresses can inadvertently be placed upside down by installation or nursing staff. This may occur in as many as one in fifty times. In the latter case, this can exacerbate the problems of fluid ingress by actually providing a reservoir for the fluids in the flap which can then penetrate the zip fastener through the teeth of the zip fastener to the mattress core. An example of such a mattress is described in U.S. Pat. No. 5,910,081 in which the top part of the mattress is folded back on itself to form a flap, and a bridge piece is inserted to join the folded leading end of the mattress cover to the top part of the cover above the fold. The bridge piece is welded to the top part of the mattress cover and stitched to the upper half of the zip fastener. The lower half of the zip fastener is stitched to the lower part of the mattress. Therefore, if the flap formed by the folding back of the top part of the mattress is displaced, for example if the mattress is placed upside down, the stitching of the zip fastener is still exposed, potentially allowing ingress of liquid through the stitching holes to the mattress core. Also, the use of a bridging piece compromises the structural integrity and strength of the cover and adds complexity to the manufacturing process.

An alternative method of creating infection control mattresses is to fully seal the mattress cover by welding all entry points. However, this is not desirable as it is necessary to inspect the core of the mattress periodically to assess the condition of the mattress core (e.g. foam) and also to assess the condition of the inside of the mattress cover. This is usually done once a year by a trained nurse who may be responsible for all mattresses in the hospital. Accordingly, fully sealing the cover is not an acceptable solution.

The invention seeks to provide a mattress cover fastener and a mattress cover including the fastener which provides a more effective closure and hence more effective infection control in a hospital environment or the like.

According to a first aspect of the present invention there is provided a mattress cover comprising:

a mattress covering material having an opening therein defined by first and second side edges of said mattress covering material and a zip fastener comprising first and second halves attached respectively to the first and second side edges, each half including an array of teeth disposed on a covering layer comprising an impermeable plastics material, said teeth being adapted to engage to close the opening, said covering layers being disposed in use towards the exterior and said teeth being disposed towards the interior such that when the zip fastener is closed said teeth are substantially covered, with respect to the exterior, by said covering layers.

In a most preferred arrangement, the mattress cover further comprises a cover flap depending from said first side edge and arranged in use to lie over the zip fastener. The cover flap thus acts to deflect any liquids which may run down the mattress in the area of the opening away from the opening and its fastener.

Preferably the covering layer comprises a substrate, such as a woven nylon based substrate, coated on its external face with an impermeable plastics material. A preferred impermeable plastics material is a polyurethane material but other materials may be used. By providing that the zip fastener is, in effect, directed internally (i.e. towards the mattress core) and covering its rear surface with the covering layers, penetration of liquids through the zip fastener is reduced or eliminated. This is particularly beneficial where a cover flap is present, in the eventuality that the mattress is placed upside down, so that the cover flap acts to collect liquids running down the mattress.

In one preferred arrangement, the second half of said zip fastener is secured to the second side edge of the mattress covering material by means of a non-punctured join such as a weld joining said covering layer to said mattress covering material.

In another preferred arrangement the cover flap is formed integrally with said mattress covering material. This avoids unnecessary joints which might compromise the strength of the mattress cover and also facilitates the manufacturing process for the mattress cover.

In an especially preferred construction, the first side edge is defined by first and second juxtaposed layers of the mattress covering material linked by a first fold in the mattress covering material and which layers are joined together along a region spaced apart from said first fold by a first non-puncturing join. The first non-puncturing join is preferably a weld. Alternative, an adhesive may be used to form the join, but this is less preferred.

Preferably in the above preferred construction, the covering layer of the first half of the zip fastener is attached to the first side edge in a region between said first fold and said first non-puncturing join and most preferably on the external face of the said side edge region, with respect to the mattress core. The first half of the zip fastener may in this construction be stitched in place, although the stitching may be just a tacking stitch to initially locate the first half of the zip fastener in position for the subsequent formation of a full joint such as a weld.

Preferably again in the above preferred construction, the cover flap comprises third and fourth juxtaposed layers of said mattress covering material linked at a leading edge by a second fold, said third layer depending from said first non-puncturing join, and a terminal edge of said fourth layer being joined to said first side edge by a second non-puncturing join in a region between said first fold and said region in which the first half of the zip fastener is attached to the first side edge. This construction is advantageous firstly in forming the cover flap integrally with the remainder of the mattress covering material and secondly in providing that the join by which the fist half of the zip fastener is attached to the first side edge is completely covered or encased, being disposed between two respective non-puncturing joins. The join between the fist half of the zip fastener and the mattress covering material is thus not exposed to the exterior (or the interior) of the mattress cover and cannot provide a path for the transmission of liquids into the mattress core. Most preferably the terminal edge of the fourth layer is joined to the first side edge by means of a weld.

According to a second aspect of the invention there is provided a mattress cover comprising

- a mattress covering material having an opening therein defined by first and second side edges of said mattress covering material
- a zip fastener comprising first and second halves attached respectively to the first and second side edges and adapted to close said opening, and
- a cover flap formed integrally with said mattress covering material, wherein
- the first side edge is defined by first and second juxtaposed layers of the mattress covering material linked by a first fold in the mattress covering material and which layers are joined together along a region spaced apart from said first fold by a first non-puncturing join,
- the second half of said zip fastener is secured to said second side edge of the mattress covering material by means of a non-punctured join joining said covering layer to said mattress covering material,
- the first half of the zip fastener is attached to the first side edge in a region between said first fold and said first non-puncturing join, and
- the cover flap comprises third and fourth juxtaposed layers of said mattress covering material linked at a leading edge by a second fold, said third layer depending from said first non-puncturing join, and a terminal edge of said fourth layer being joined to said first side edge by a second non-puncturing join in a region between said first fold and said region in which the first half of the zip fastener is attached to the first side edge.

Preferably in this second aspect of the invention said first and or second non-puncturing joins are welds.

The non-punctured join by means of which the second side edge is attached to the second half of the zip fastener may include a tacking stitch used to initially locate the second half of the zip fastener in the desired position, with the joint then being completed by a weld or the like which also serves to close the punctures caused by the stitching.

In a most preferred construction according to this second aspect of the invention, each half of the zip fastener includes an array of teeth disposed on a covering layer comprising an impermeable plastics material, said teeth being adapted to engage to close the opening, said covering layers being disposed in use towards the exterior and said teeth being disposed towards the interior such that when the zip fastener is closed said teeth are substantially covered, with respect to the exterior, by said covering layers.

Most preferably in the present invention the mattress covering material is selected so that its stretching properties mimic as closely as possible those of the skin. In this way, friction and shear forces on the skin are reduced, assisting in the prevention of pressure sores. A suitable material is a coated polyester knit fabric comprising a polyester base weave with a suitable coating such as a polyurethane. Typically the fabric will have a total weight of about 220 $gm^{-2}$, with the coating comprising about 80 to 100 $gm^{-2}$.

It may be noted that the coating of plastics material does not necessarily render the zip fastener completely sealed, but nevertheless has the capability of preventing the ingress of fluids under normal working conditions. The preferred construction of a nylon substrate coated with a polyurethane material effectively reduces the gap of the teeth of the zip fastener to a very low level, for example in the order of half a millimetre or less. This offers a barrier to the possible ingress of fluids or infection. In order that the zip fastener can be opened, the zip slider or puller is preferably of a "reverse" formation, that is the grippable puller is arranged at the back of the zip rather than at the front, or zip-teeth side, as is more normal. In this case, the teeth face inwardly towards the mattress core and the back of the zip faces outwardly away from the mattress core in use.

As noted above, according to the invention, a unique flap is utilised in addition to the advantageous zip fastener construction as referred to above. In this, the fabric of the cover flap is folded back and the zip fastener is attached to the folded area through two thicknesses of the fabric, initially by stitching. A first weld is made between the two thicknesses of the cover fabric adjacent the sewn area to provide a seal and act as waterproofing. The free end of the cover flap is then folded back on itself and secured (such as by welding) to the mattress covering material on the zip fastener on the other side of the stitched area to the first weld. This then isolates the stitched area with a weld on either side preventing fluid ingress. The other half of the zip fastener is preferably welded to the other side of the cover fabric, again utilising the plastics material coating on the zip. This then ensures that there is no stitching, unprotected by welded areas, through which water or other fluids can enter the mattress core.

The invention will be described further, by way of example, with reference to the accompanying drawings, in which.

Figure 4:
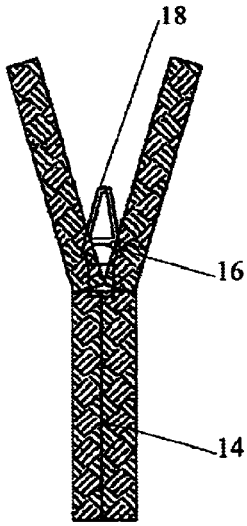
FIG. 4 is a similar view to FIG. 3 from the outside.
Figure 3:
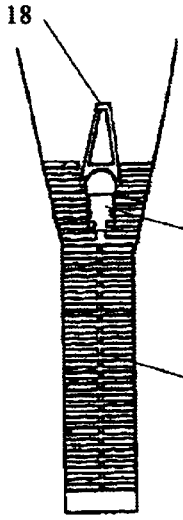
FIG. 3 illustrates the zip fastener from the inside being opened/closed.

Referring to the drawings, a mattress cover in accordance with the invention comprises a water impermeable material and includes a zip fastener (or zipper) generally designated 10 to enable the mattress cover to be put on the mattress core and/or removed. The zip fastener 10 comprises zip teeth 12 which, in a conventional construction, would be on the outer side of the cover. However, in accordance with the invention, they are arranged to be on the inside in use, that is, towards the mattress core. The zip teeth are mounted on a substrate which is coated with a plastics material 14, for example, polyurethane. The coating is preferably on the external face of the zip fastener 10, that is, opposite the teeth 12. To enable the zip fastener 10 to be opened and closed, a slider 16 is provided which is in reverse of the conventional construction having a puller 18 on the outside, i.e. the side opposite to the teeth 12.

Figure 5:
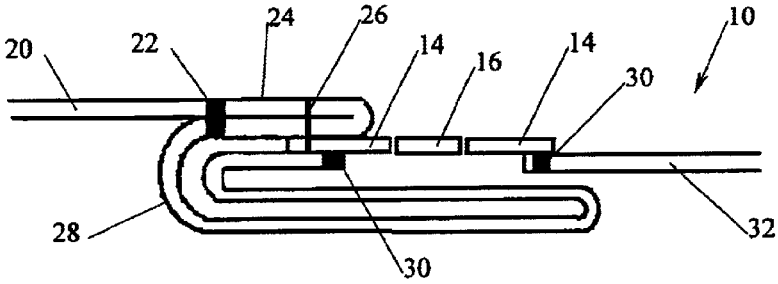
FIG. 5 is a diagrammatic sectional view through the zip fastener and cover flap.
Figure 1:
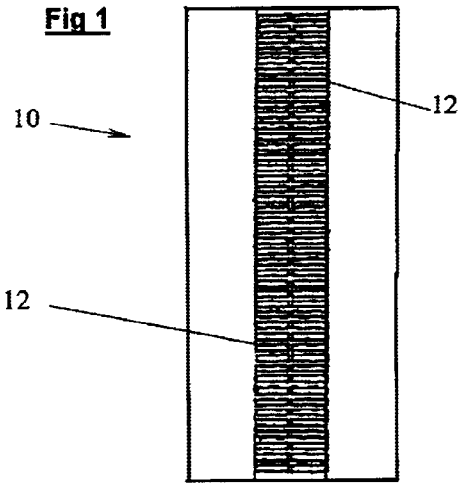
FIG. 1 is a diagrammatic view of part of a mattress cover having a zip fastener, in accordance with the invention, from the inside.
Figure 2:
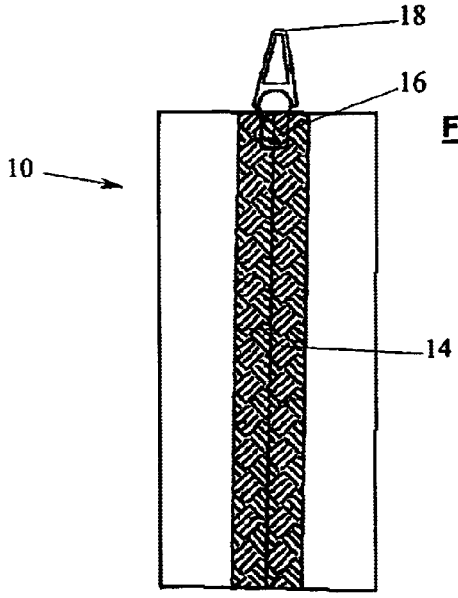
FIG. 2 is a similar view to FIG. 1 from the outside.

Reference to FIG. 5 illustrates how the zip fastener 10 is attached to the cover. The top portion 20 of the covering material is folded back on itself to form in area 24 juxtaposed layers of the covering material, and a non puncturing join such as a weld is formed at 22. The doubled area 24 is then attached to one side of the zip fastener 10. This attachment may initially be by stitching 26, to hold the zip fastener temporarily in place until a more permanent joint, such as a weld is formed. The stitching goes through the zip fastener 10 and two layers of covering material. The free portion 28 of the flap is folded back on itself to form further juxtaposed layers and welded to the plastics material 14 on the outer surface of the zip 10 at 30. The stitched area 26 is therefore isolated by the welds 30 and 22 rendering it impermeable to liquids or moisture. The bottom portion of the cover material 32 is attached to the other side of the zip fastener 10 by suitable non-puncturing means such as by welding to the plastics material 14 at 34.

As illustrated in FIG. 5, the flap portion 28 overhangs the zipped area and protects it from ingress of fluids. Nevertheless, even if fluids were to get under the flap into the zipped area (such as if the mattress is placed upside down) the plastic coating 14, act substantially to prevent ingress of liquid through the zip teeth 12 and the welds 30 and 34 prevent ingress where the zip is attached.

The method of attachment of, and the construction of, the zip fastener of the invention therefore prevents ingress of fluids into the mattress core in a simple, economical and effective manner. When used with the preferred flap arrangement as illustrated in FIG. 5, a very high degree of security is achieved and yet the mattress cover can be removed periodically for inspection.

What is claimed is:

1. A mattress cover comprising a mattress covering material having an opening therein defined by first and second side edges of said mattress covering material a zip fastener comprising first and second halves attached respectively to the first and second side edges and adapted to close said opening, and a cover flap formed integrally with said mattress covering material, wherein (a) the first side edge is defined by first and second juxtaposed layers of the mattress covering material linked by a first fold in the mattress covering material and which layers are joined together along a region spaced apart from said first fold by a first non-puncturing join, (b) the second half of said zip fastener is secured to said second side edge of the mattress covering material by means of a non-punctured joint, (c) the first half of the zip fastener is attached to the first side edge in a region between said first fold and said first non-puncturing join, and (d) the cover flap comprises third and fourth juxtaposed layers of said mattress covering material linked at a leading edge by a second fold, said third layer depending from said first non-puncturing join, and a terminal edge of said fourth layer being joined to said first side edge by a second non-puncturing join in a region between said first fold and said region in which the first half of the zip fastener is attached to the first side edge.

2. A mattress cover as claimed in claim 1 wherein the cover flap depends from adjacent said first side edge and arranged in use to lie over the zip fastener.

3. A mattress cover as claimed in claim 1 wherein said first and or second non-puncturing joins are welds.

4. A mattress cover as claimed in claim 1 wherein each half of the zip fastener includes an array of teeth disposed on a covering layer comprising an impermeable plastics material, said teeth being adapted to engage to close the opening, said covering layers being disposed in use towards the exterior and said teeth being disposed towards the interior such that when the zip fastener is closed said teeth are substantially covered, with respect to the exterior, by said covering layers.

5. A mattress cover as claimed in claim 4 wherein said covering layer comprises a substrate coated on its external face with an impermeable plastics material.

6. A mattress cover as claimed in claim 5 wherein said impermeable plastics material is a polyurethane material.

7. A mattress comprising a mattress cover according to claim 1 and a mattress core disposed within the cover.

* * * * *